US005941025A

United States Patent [19]

Chang

[11] Patent Number: 5,941,025

[45] Date of Patent: Aug. 24, 1999

[54] RAPIDLY ADJUSTABLE MAN-HOLE COVER SEAT

[76] Inventor: Ming Huang Chang, No.25, Tzu Chiang Rd., Chi Tu Dist., Keelung, Taiwan

[21] Appl. No.: 09/139,581

[22] Filed: Aug. 25, 1998

[51] Int. Cl.[6] ..... E02D 29/14

[52] U.S. Cl. ..... 52/20; 404/26

[58] Field of Search ..... 49/463; 52/19, 52/20, 21; 404/25, 26

[56] References Cited

U.S. PATENT DOCUMENTS

| | | | |
|---|---|---|---|
| 3,858,998 | 1/1975 | Larsson et al. | 52/19 X |
| 4,582,450 | 4/1986 | Neil | 52/20 X |
| 4,719,724 | 1/1988 | Ditcher | 52/20 |
| 5,344,253 | 9/1994 | Sacchetti | 52/20 X |
| 5,697,729 | 12/1997 | Bowman | 52/20 X |

*Primary Examiner*—Jerry Redman
*Attorney, Agent, or Firm*—Rosenberg, Klein & Bilker

[57] ABSTRACT

A rapidly adjustable man-hole cover seat for sustaining the alignment of a road surface and a man-hole cover, comprises a base, an adjustable seat, a man-hole cover and a cruciform hole fixing frame, a stud block, a supporting block, etc. In a large distance adjustment, the inner rim of the adjustable seat is designed so that it may be penetrated by adjustable screws. Thus the adjustable seat may be adjusted and moved for aligning with the road surface. In another small distance adjustment, a cruciform hole fixing frames are installed on the bottom of the adjustable seat for being penetrated by screws so as to be installed on the base. Further, supporting blocks are installed for distributing the weight borne by the adjustable seat, the stud block and screws so that the man-hole cover may suffer a heavy pressure and the steadiness of the man-hole cover and road surface as cars are passing is sustain.

1 Claim, 8 Drawing Sheets

RAPIDLY ADJUSTABLE MAN-HOLE COVER SEAT

BACKGROUND OF THE INVENTION

The present invention relates to a rapidly adjustable man-hole cover seat for sustaining the alignment of a road surface and a man-hole cover.

The prior art man-hole cover seat has a fixing size, thus it is very difficult for a embedded man-hole cover to align with a road surface. Especially, if the road is repaired many times, the road surface and the man-hole cover are not in the same elevation level. Therefore, the road forms many obstacles with concave and convex portions. This will prevent the normal driving of cars and induce the problem of the traffic safety.

SUMMARY OF THE INVENTION

Accordingly, the object of the present invention is to provide a rapidly adjustable man-hole cover seat for sustaining the alignment of a road surface and a man-hole cover, so that a more smooth road are obtained.

In order to achieve said object, in the present invention, a large distance adjustment is provided, wherein, the inner rim of the adjustable seat is designed so that it may be penetrated by adjustable screws. Thus the adjustable seat may be adjusted and moved for aligning with the road surface.

Another, another small distance adjustment is further provided in the present invention, wherein, a cruciform hole fixing frames are installed on the bottom of the adjustable seat for being penetrated by screws so as to be installed on the base.

Further, supporting blocks are installed for distributing the weight borne by the adjustable seat, the stud blocks and screws so that the man-hole cover may suffer a heavy pressure and the steadiness of the man-hole cover and road are retained The present invention will be better understood and its numerous objects and advantages will become apparent to those skilled in the art by referencing to the following drawings in which:

DETAILED DESCRIPTION OF THE PREFERRED EMBODIMENT

Figure 1:
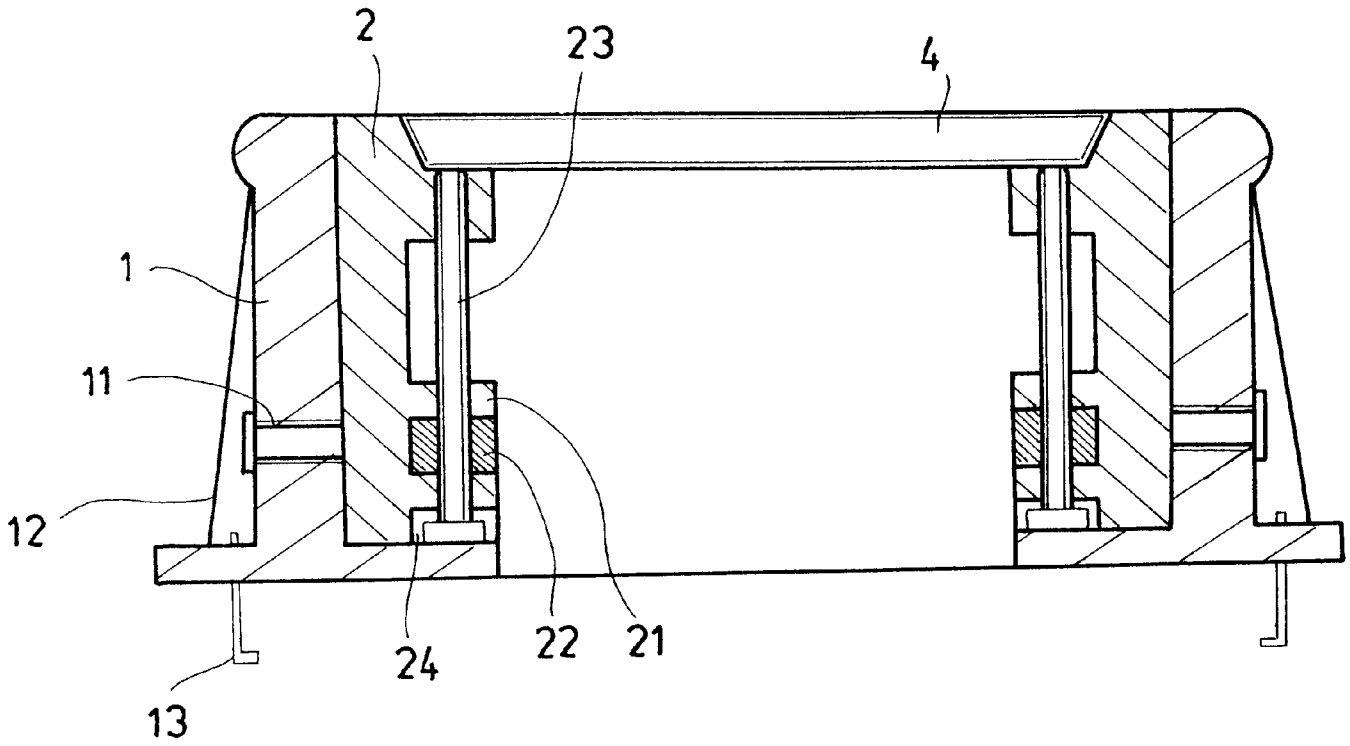
FIG. 1 is an exploded view of the present invention.

Referring to FIG. 1, The man-hole cover seat of the present invention comprises a base (1), an adjustable seat (2), a cruciform hole fixing frame (3), a man-hole cover (4), and a supporting block (6).

A receiving space is contained in the base (1) for receiving an adjustable seat (2). Near the bottom of the space are installed with symmetric installing holes (11). Fixing screws are used to fix the base (1) into the earth. Then a protect housing (12) is used to cover the structure. Therefore, the earth and stone may be put around the base (1).

A plurality of upper and lower supporting frames (21) are formed on the inner rim of the adjustable seat (2). These supporting frames may be used to receiving a stud block (22) so that it may be arranged on the bottom of the screw fixing frame (24) adjusted A cruciform hole (32) may be passed by a screw (31) so to be fixed on the installing hole (11) of the base (1).

The man-hole cover (4) is positioned on the adjustable seat (4).

Figure 2:
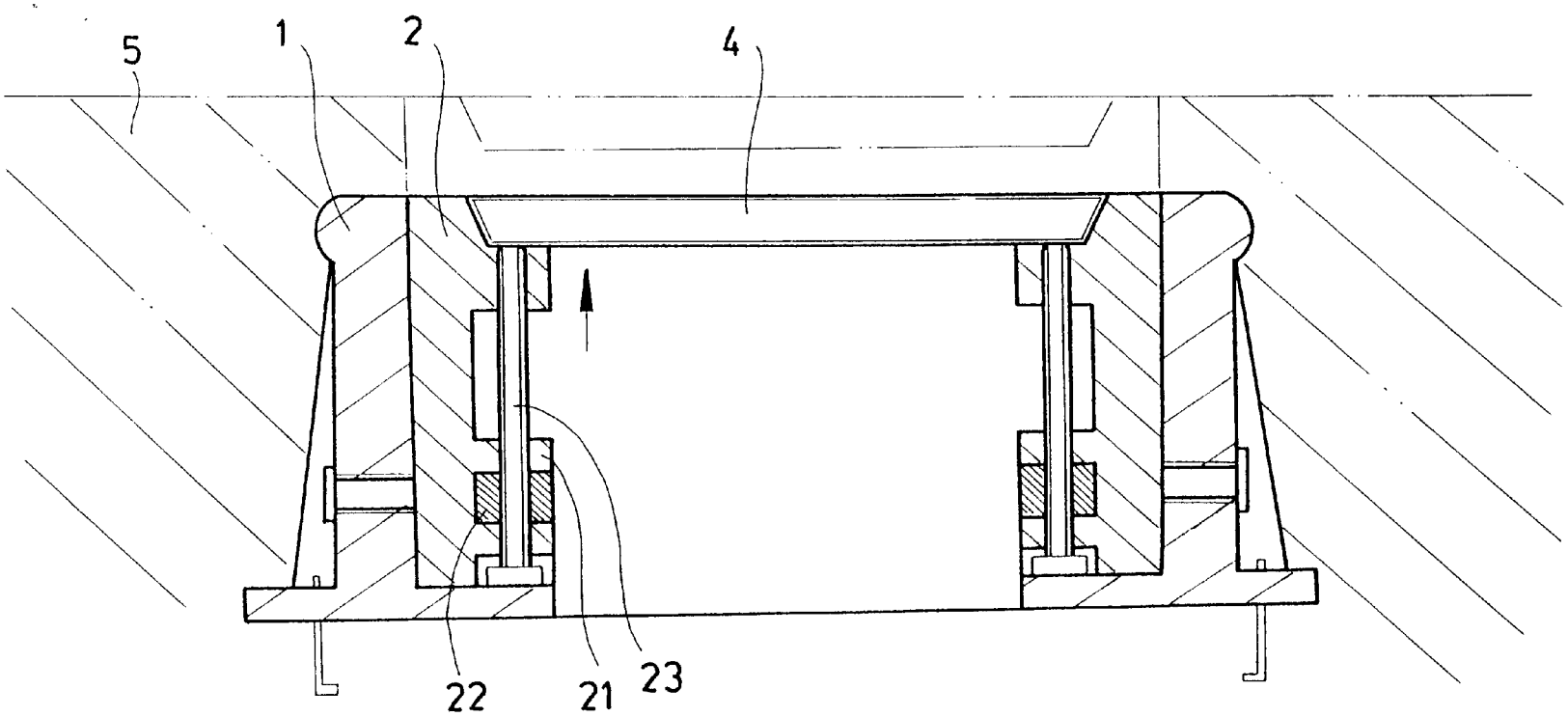
FIG. 2 is a schematic view of the embodiment of a large adjustment of the present invention.
Figure 3:
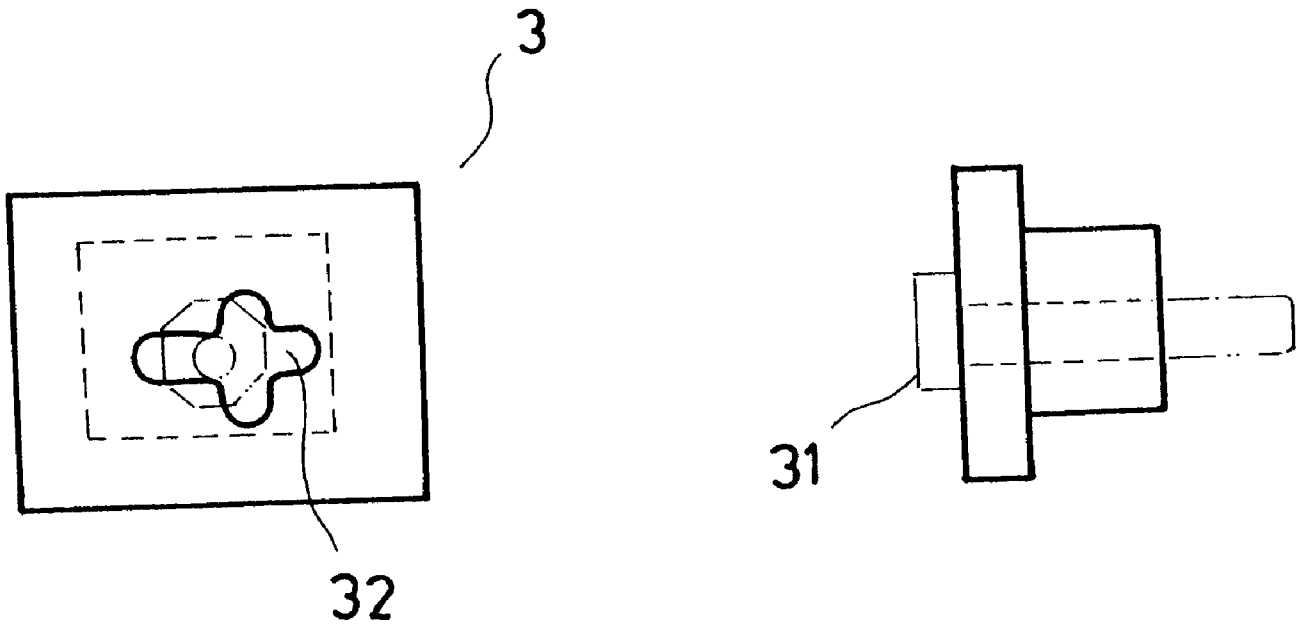
FIG. 3 is a side view of the cruciform hole fixing frame of the present invention.
Figure 4:
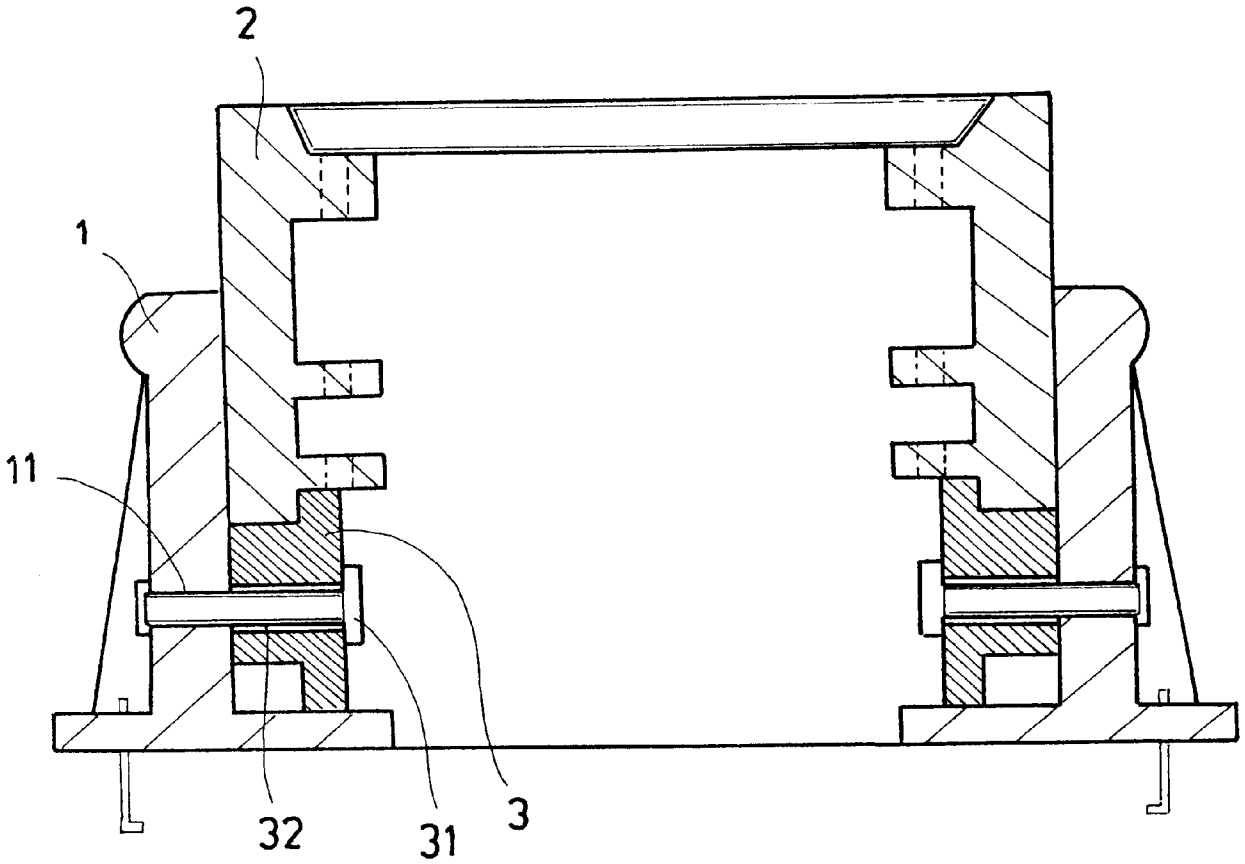
FIG. 4 is a cross sectional view of the cruciform hole fixing frame of the present invention.
Figure 5:
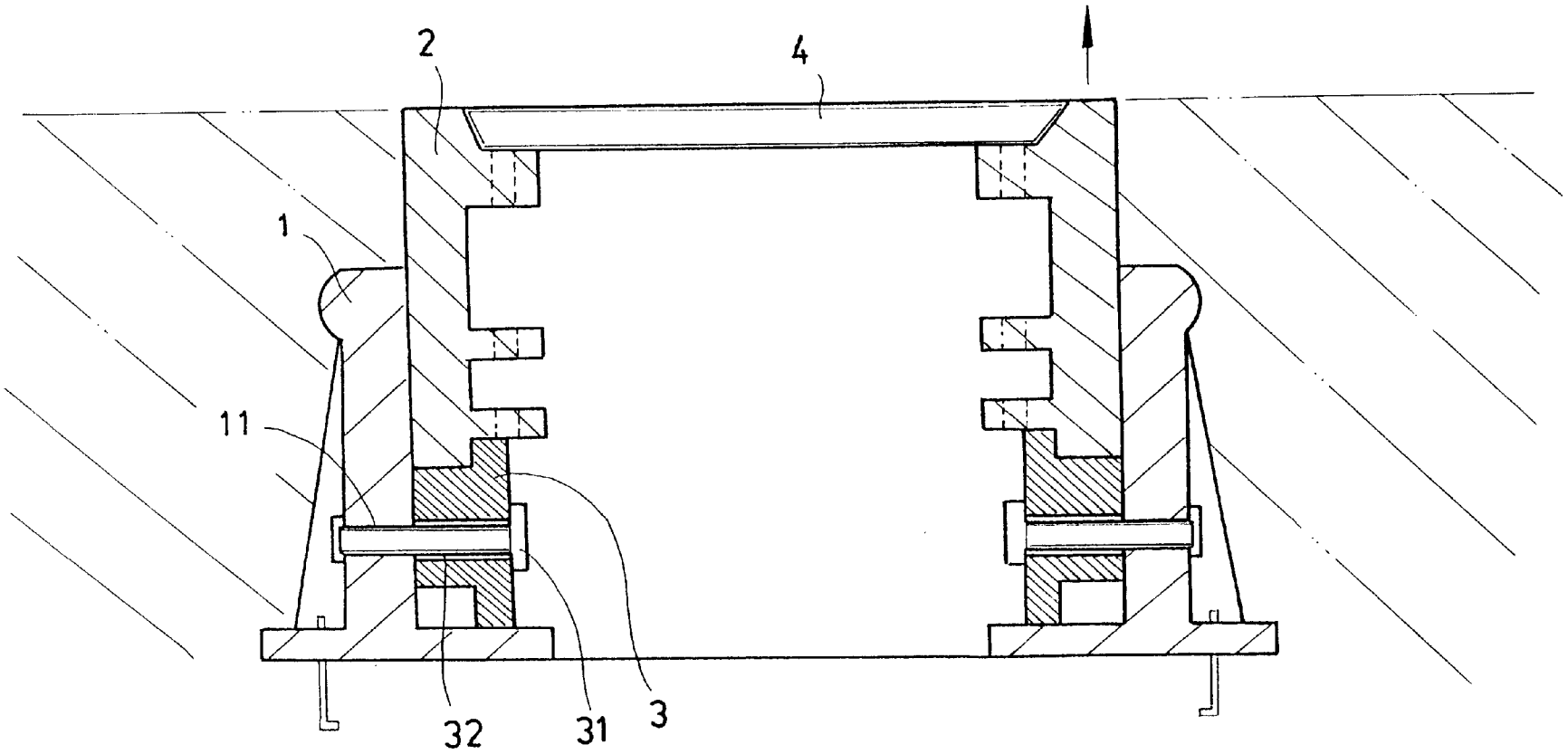
FIG. 5 is a schematic view of the embodiment of a small adjustment of the present invention.

By the aforementioned structure, an adjustment manner for a large distance is described herein. Referring to FIGS. 1 and 2, since a plurality of supporting frames (21) are installed on the inner rim of the adjustable seat (2), during adjusting, the stud block (22) is received, and an adjusting screw is passed. Then a pneumatic sleeve is used to rotate the adjustable screw (23), then the adjustable seat (2) may be lifted or descended successfully. Therefore, when the elevation difference between the elevations of the base (1) and the stones on a road is large, an adjustable screw (23) may be used to adjust the adjustable seat (2) so to be aligned with the road surface. Then the man-hole cover (4) can be covered. This is a way of large distance adjustment.

Another manner could be used to embody the present invention, namely, a small distance adjustment. The cruciform hole fixing frame (3) symmetric arranged on the bottom of the adjustable seat (2) is deposited within the installing holes (11) by screws (31) passing the cruciform hole (32) for supporting the adjustable seat (2). Since the cruciform hole fixing frame (3) has a cruciform slot, thus the adjusting distance is confined within the range of the cruciform hole (32). This kind of design is used in the condition that the man-hole cover (4) is often opened. Therefore, the elevation difference between the man-hole cover (4) and the road surface is small.

Figure 6:
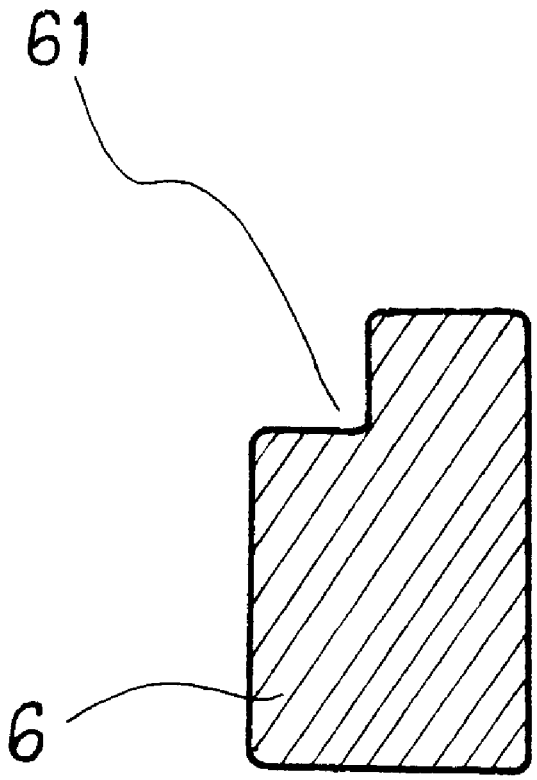
FIG. 6 is a cross sectional view of the supporting block of the present invention.
Figure 7:
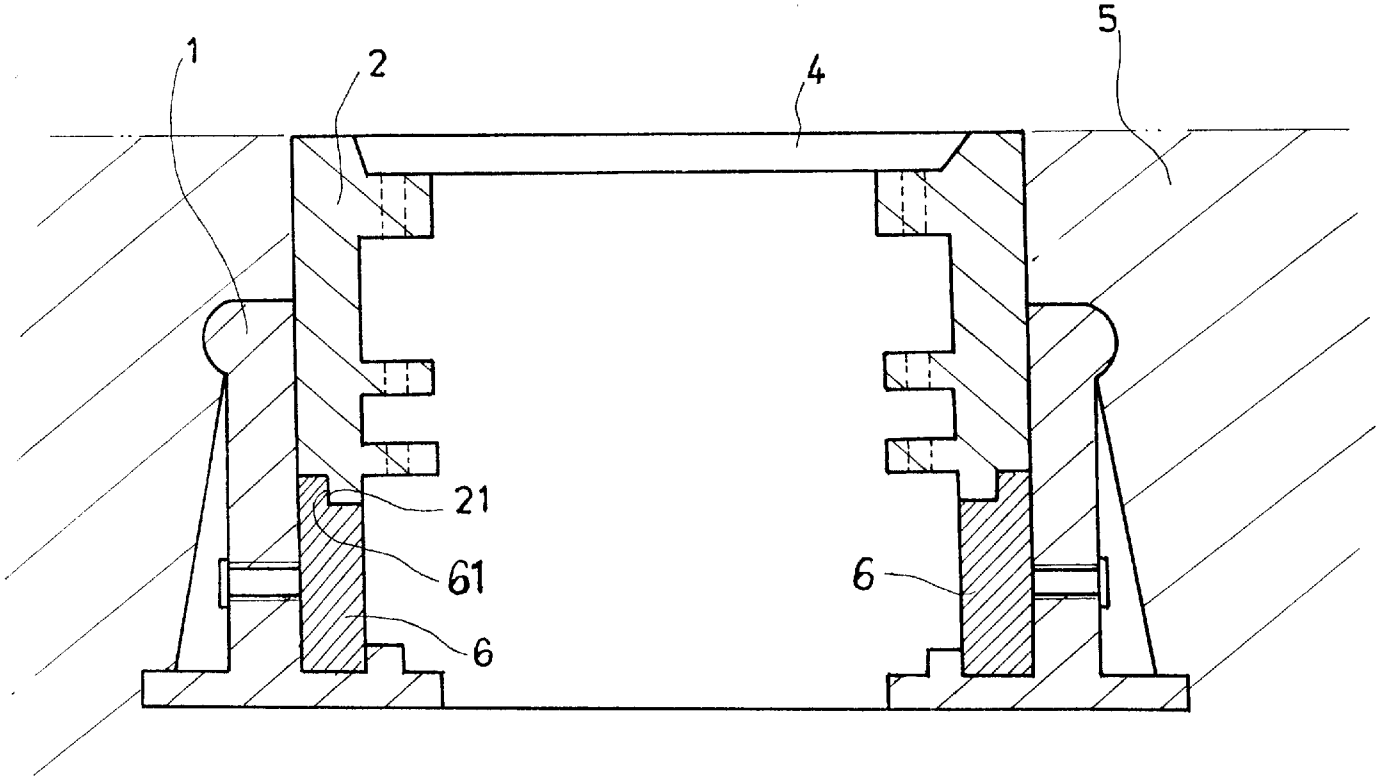
FIG. 7 is a schematic view of an embodiment for installing the supporting blocks of the present invention.

Further referring to FIGS. 6 and 7, a supporting block (6) is arranged on the bottom of an adjustable seat (2) and the upper end thereof is formed with a ladder upper portion (61) which may match the ladder lower portion (25) of the adjustable seat (2).

Since the top portion of the supporting block (6) has a ladder top portion (61), when it is located within the ladder lower portion (25) of the adjustable seat (2), they are engaged with the ladders. Thus, the adjustable seat (2) below the supporting block (6) will not shift or unsteady. Meanwhile, after the supporting blocks (6) have been located in the predetermined position, since the upper surfaces of the adjustable seat (2) and the man-hole cover (4) will bear the weight of the car passing through the man-hole cover, after the supporting block (6) has been arranged, it can support the adjustable seat (2) completely. Thus the weight suffered on the top surface is borne completely. Accordingly, the man-hole cover will not become concave.

Figure 8:
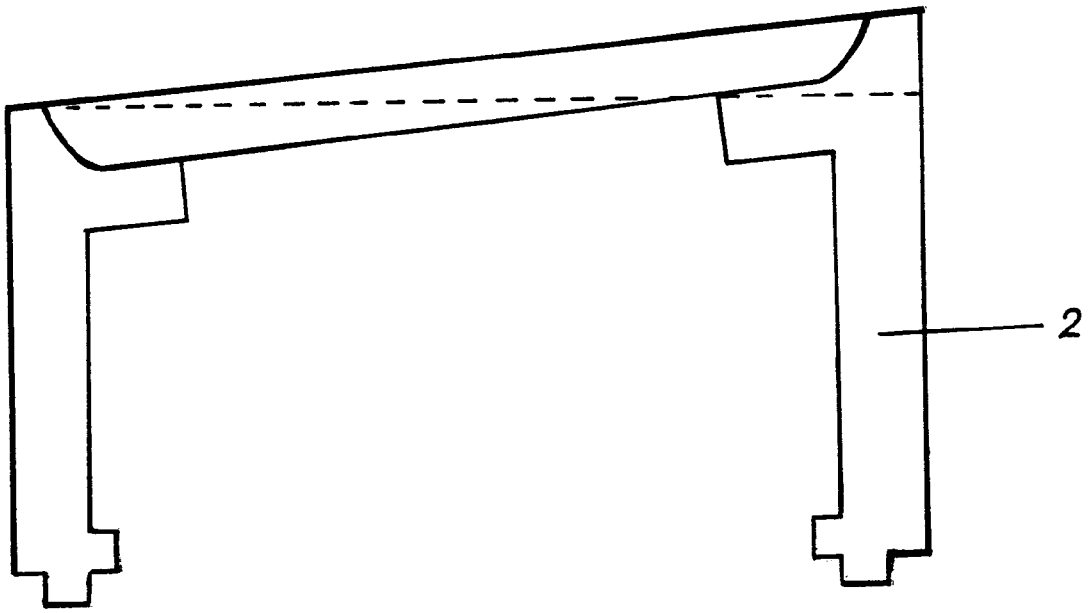
FIG. 8 shows the embodiment of the adjustable seat of the present invention.

Referring to FIG. 8, another embodiment of the adjustable seat (2) is shown. In this the present invention, the adjustable seat (2) is formed as a device with an inclined surface, which is suitable in special conditions (for example, an inclined or a sloped roads) so that the adjustable seat (2) may further match the road conditions. Thus it may be fill aligned with the road surface.

In the present invention, adjusting types for large distance, small distance and sloping roads are disclosed so that the man-hole cover and the road may be aligned. Another, supporting blocks are further installed for bearing large presses. Accordingly, the present invention may sustain the steady condition of the road and the safety of car and people are sustained.

Although certain preferred embodiment of the present invention has been shown and described in detail, it should be understood that various changes and modification may be made therein without departing from the scope of the appended claims.

What is claimed is:

1. A rapidly adjustable man-hole cover seat, comprising:

a base having an open cavity formed therein and an annular flange formed on a lower end thereof, said having a plurality of installing holes formed through an annular wall thereof;

an adjustable seat disposed in said cavity and being adjustably vertically displaceable therein, said adjustable seat having an annular wall and a plurality of supporting frames extending from an inner surface of said annular wall;

a plurality of stud blocks disposed between respective pairs of said supporting fames;

a plurality of adjustable screws, each of said adjustable screws having one end in contiguous contact with said annular flange and a body portion thereof extending through respective openings of respective pairs of said supporting frames and a respective one of said stud blocks; and, a plurality screws respectively disposed in said plurality of installing holes for affixing said adjustable seat to said base.

* * * * *